US005467853A

United States Patent [19]

Pelletier

[11] Patent Number: 5,467,853

[45] Date of Patent: Nov. 21, 1995

[54] CHILDREN'S ACTIVITY CASE

[76] Inventor: Wendy Pelletier, Box 1185, Station A, Prince George, British Columbia, Canada, V2L 4V2

[21] Appl. No.: 260,724

[22] Filed: Jun. 15, 1994

[51] Int. Cl.[6] ..... A47B 3/10

[52] U.S. Cl. ..... 190/11; 190/114; 383/99; 383/121.1

[58] Field of Search ..... 383/4, 97, 98, 383/99, 119, 121.1; 190/114, 11; 206/320; 224/202

[56] References Cited

U.S. PATENT DOCUMENTS

| | | | |
|---|---|---|---|
| 2,123,454 | 7/1938 | Doppelt | 190/114 |
| 2,144,266 | 1/1939 | Nathan | 190/114 |
| 3,073,367 | 1/1963 | Samara | 383/97 |
| 4,210,230 | 7/1980 | Weiner | 383/104 X |
| 4,515,493 | 5/1985 | Radovich | 190/11 X |
| 4,564,091 | 1/1986 | Coneglio | 190/11 X |
| 4,773,515 | 9/1988 | Kotkins, Jr. | 383/97 X |
| 4,881,684 | 11/1989 | Chinman | 383/4 X |
| 4,930,903 | 6/1990 | Maheney | 383/121.1 X |
| 5,297,870 | 3/1994 | Weldon | 383/99 X |

*Primary Examiner*—Allan N. Shoap
*Assistant Examiner*—Christopher J. McDonald
*Attorney, Agent, or Firm*—Fetherstonhaugh & Company

[57] ABSTRACT

A child's activity case opens up to form a desk that sits on a child's lap. The activity case can be filled with toys, coloring books, crayons, etc., to keep a child occupied during times that children have to keep sitting such as in a car. The case comprises a flexible satchel made from fabric having a board member in a base of the satchel. Opposing flaps are positioned on top of the satchel having zippers on either sides, the flaps overlap each other and have attachments to hold them together and retain the flaps closed. The flaps have inside pockets, and a carrying strap is provided to carry the case like a satchel.

4 Claims, 1 Drawing Sheet

CHILDREN'S ACTIVITY CASE

TECHNICAL FIELD

The present invention relates to a child's activity case and more specifically to a pack or satchel suitable for children that opens up to form a desk that sits on a child's lap.

BACKGROUND ART

Children who are travelling in cars or airplanes, or children who are required to sit down in, for example, restaurants, churches, waiting rooms, and the like, require some form of activity to keep them occupied. Children tend to get bored quickly, and if one can hold their attention for some time, then adults accompanying the children can concentrate on other matters and not have to play with the children. This is particularly useful when, for instance, a mother is driving a car and a child is sitting strapped into a child's seat.

DISCLOSURE OF INVENTION

The present invention provides a children's activity case which has a built in desk. The case has two flaps that open outward, the flaps having pockets therein that have closures to hold toys, crayons, and the like. The bottom of the case has a hard panel which becomes a working surface or a desk surface. The activity case, as well as being closable, is foldable or collapsible at the sides so that it can vary in depth to hold more toys, snacks, lunch, other books and the like. A strap is provided so that the child can turn the activity case into a satchel, school bag and the like.

The present invention provides a children's activity case comprising a flexible satchel made from fabric and having a board member in a base of the satchel, opposing flaps on top of the satchel, having zippers on either side, the flaps overlapping at the center and having attachment means to retain the flaps closed, the flaps having pockets on the inside thereof, and a carrying strap attached to the activity case.

BRIEF DESCRIPTION OF DRAWINGS

In drawings which illustrate embodiments of the present invention.

BEST MODE FOR CARRYING OUT THE INVENTION

Figure 1:
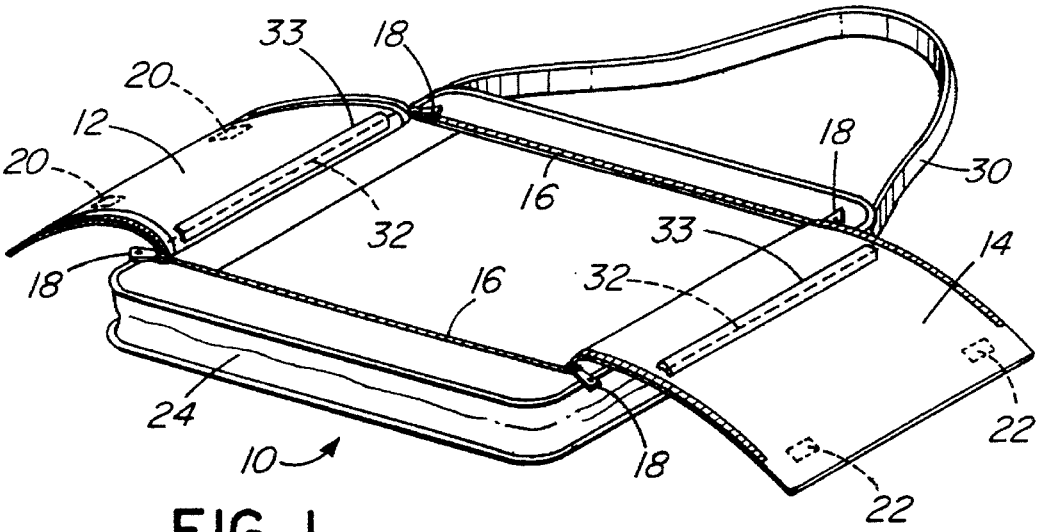
FIG. 1 is an isometric view showing one embodiment of a children's activity case according to the present invention in the open position.
Figure 2:
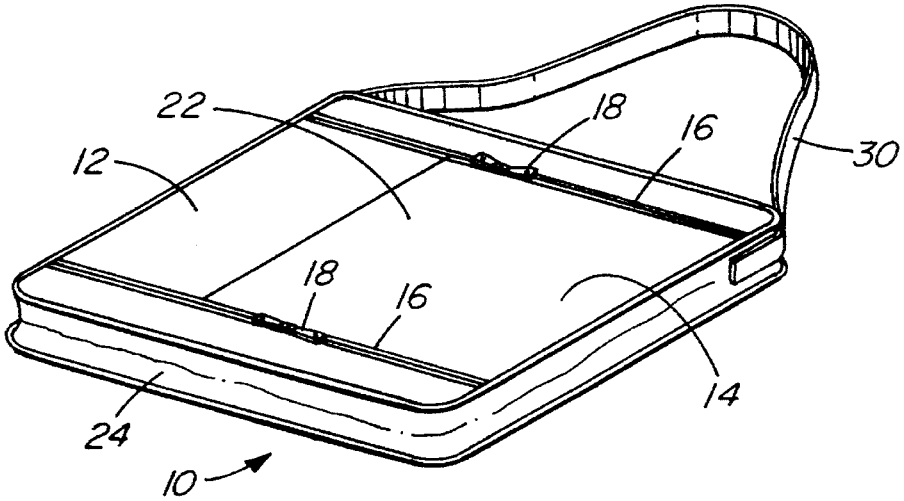
FIG. 2 is an isometric view showing the children's activity case of FIG. 1 in the closed position.
Figure 3:
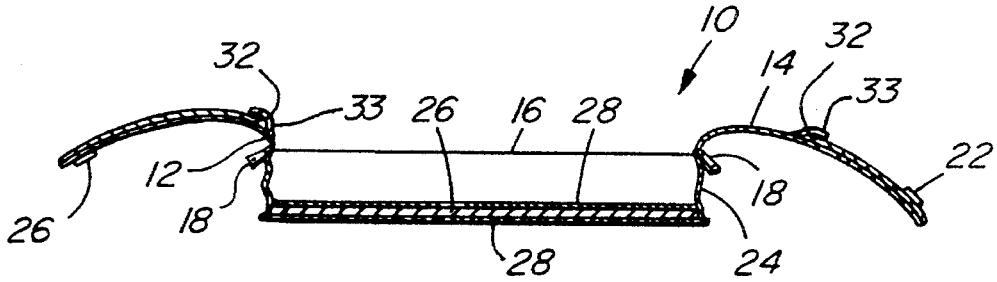
FIG. 3 is a side elevational view showing the children's activity case of FIG. 1 in the open position.

Referring now to the drawings, the activity case 10 as shown in FIG. 1 is made out of a fabric, preferably a nylon fabric which has been waterproofed. The case is made in the form of a satchel 10 which is substantially oblong in shape and has at a top surface a first flap 12 and a second flap 14. FIG. 1 shows the first flap 12 and the second flap 14 in the open position, and FIG. 2 shows the first flap 12 and the second flap 14 closed. Zipper tracks 16 are provided on the sides of the flaps 12,14 and the zipper heads 18 close across the top surface to zipper the two flaps 12,14 to the sides of the satchel 10. The first flap 12 closes first and the second flap 14 then closes over the first flap. The first flap 12 has two Velcro patches 20 on the top surface and the second flap 14 has mating Velcro patches 22 which when the second flap 14 is closed mate with the Velcro patches 20 on the first flap.

These Velcro patches hold the two flaps 12,14 together and the zipper heads 18 at each end of the zipper tracks 16, are pulled in towards the center of the satchel 10 to close the sides of the flaps 12,14.

The sides 24 of the satchel 10 are collapsible, accordion style, and made of nylon fabric, thus permitting the satchel 10 to be collapsed to a substantially flat state when empty. The collapsible sides 24 also permit the satchel 10 to be expanded when it is full of toys, books, and the like. The bottom or base of the satchel 10 has a board 26, in a fabric cover 28. The board 26 represents a table top or desk top that can be used by a child for playing a game or drawing upon. The board 26 takes up the whole of the base of the satchel 10.

A strap 30 is provided attached at ends of the satchel 10, for carrying the activity case like a satchel or school bag.

The first flap 12 and second flap 14 have pockets 32 on the inside which can be used for holding coloring books, pads, crayons, pencils, pencil sharpeners, erasers, and the like. The pockets 32 have flaps 33 which close and contain objects placed therein.

The children's activity case 10 is preferably provided in kit form which includes a coloring book, crayons, games, etc. Thus, when the activity case is provided for a child, it can be placed on the child's lap, the zipper heads 18 pulled back and the flaps 12,14 opened. The child then has a desk which rests upon the child's lap or upper legs with coloring books, crayons, pads, etc., in the flap pockets 32. Thus the child can remain occupied while sitting down as for example in a car or in a restaurant.

As well as activity toys for children, school books may be placed within the activity case and the case itself may be used as a school satchel. In another embodiment the child may carry lunch or snacks therein, and the collapsible sides 24 permit the thickness or depth of the satchel 10 to be increased to hold the items placed therein.

Various changes may be made to the embodiments shown herein without departing from the scope of the present invention which is limited only by the following claims.

The embodiments of the present invention in which an exclusive property or privilege is claimed are defined as follows:

1. A children's activity case comprising:

a flexible satchel made from fabric, having a substantially rectangular board member in a substantially rectangular base of the satchel with four sides extending., upwards and joined at corners;

opposing flaps on top of two opposing sides of the satchel, each flap having parallel edges, and an outer and inner surface, the flaps having zippers on the parallel edges, the flaps overlapping at the center when closed to form a substantially rectangular top surface, substantially the same size and parallel to the base of the satchel, attachment means on the flaps to retain the flaps closed, the flaps having pockets on the inner surface thereof, and a carrying strap attached to the activity case.

2. The children's activity case according to claim 1 wherein the fabric is a waterproofed nylon fabric.

3. The children's activity case according to claim 1, the satchel having collapsible sides to vary the thickness of the satchel.

4. The children's activity case according to claim 1 wherein the pockets have closures to retain items therein.

* * * * *